United States Patent [19]

Shotwell

[11] 4,241,693

[45] Dec. 30, 1980

[54] PAINT GUIDE

[76] Inventor: Allen M. Shotwell, 207 Simpson-Howell Rd., Elizabeth, Allegheny County, Pa. 15037

[21] Appl. No.: 108,809

[22] Filed: Dec. 31, 1979

[51] Int. Cl.[3] ..... B05C 11/00

[52] U.S. Cl. ..... 118/504

[58] Field of Search ..... 118/504, 505; 427/272, 427/282, 286; 51/262 R, 262.1, 274, 310

[56] References Cited

U.S. PATENT DOCUMENTS

| | | | |
|---|---|---|---|
| 804,569 | 11/1905 | Watson | 118/504 |
| 1,386,706 | 8/1921 | Hall | 118/504 |
| 1,411,462 | 4/1922 | Wendt | 118/504 |
| 2,098,005 | 11/1937 | Holt | 118/504 |
| 2,484,607 | 10/1949 | Cherem | 118/504 |
| 2,517,220 | 8/1950 | Lister | 118/504 |
| 2,538,743 | 1/1951 | Alston | 118/504 |
| 3,335,703 | 8/1967 | Buehler | 118/504 |

FOREIGN PATENT DOCUMENTS

| | | | |
|---|---|---|---|
| 5156 | of 1910 | United Kingdom | 118/504 |
| 683776 | 12/1952 | United Kingdom | 118/504 |
| 911553 | 11/1962 | United Kingdom | 118/505 |

*Primary Examiner*—Morris Kaplan

*Attorney, Agent, or Firm*—Frease & Bishop

[57] ABSTRACT

A paint guide has an inverted U-shaped frame with a flexible paint shield terminating in a straight edge which is adapted to be spaced a predetermined distance from a window frame to provide for a strip of weatherproofing paint on the glass adjacent the frame. An L-shaped bracket is adjustably mounted on each of the ends of the frame and is pivotally slidably mounted on an elongated supporting arm by a link and slidable pivot pin arrangement. A coil leaf spring extends between the bracket and arm and biases the bracket away from the arm to move the paint shield edge out of engagement with the glass. A tab is provided on each of the arms and is located rearwardly of and beneath the fronts of the arms to support the paint guide on a pane of glass when the arm fronts are placed in abutting engagement with the frame. When inward pressure is applied to a handle, which is mounted on the frame, the paint edge is moved vertically into engagement with the glass and spaced a predetermined distance outwardly from the frame due to the engagement of the links in the bracket slots. Continued pressure on the handle seals the paint edge tightly against the glass as the rear portion of the frame moves slightly rearwardly due to the flexibility of the paint shield and the slidable pivot pin mounting arrangement between the bracket and arm. After completion of the paint application between the arms, the pressure on the handle is released, whereupon the leaf spring raises the paint edge vertically from the glass, after which the guide is slid to an adjacent unpainted area.

15 Claims, 8 Drawing Figures

FIG. 1
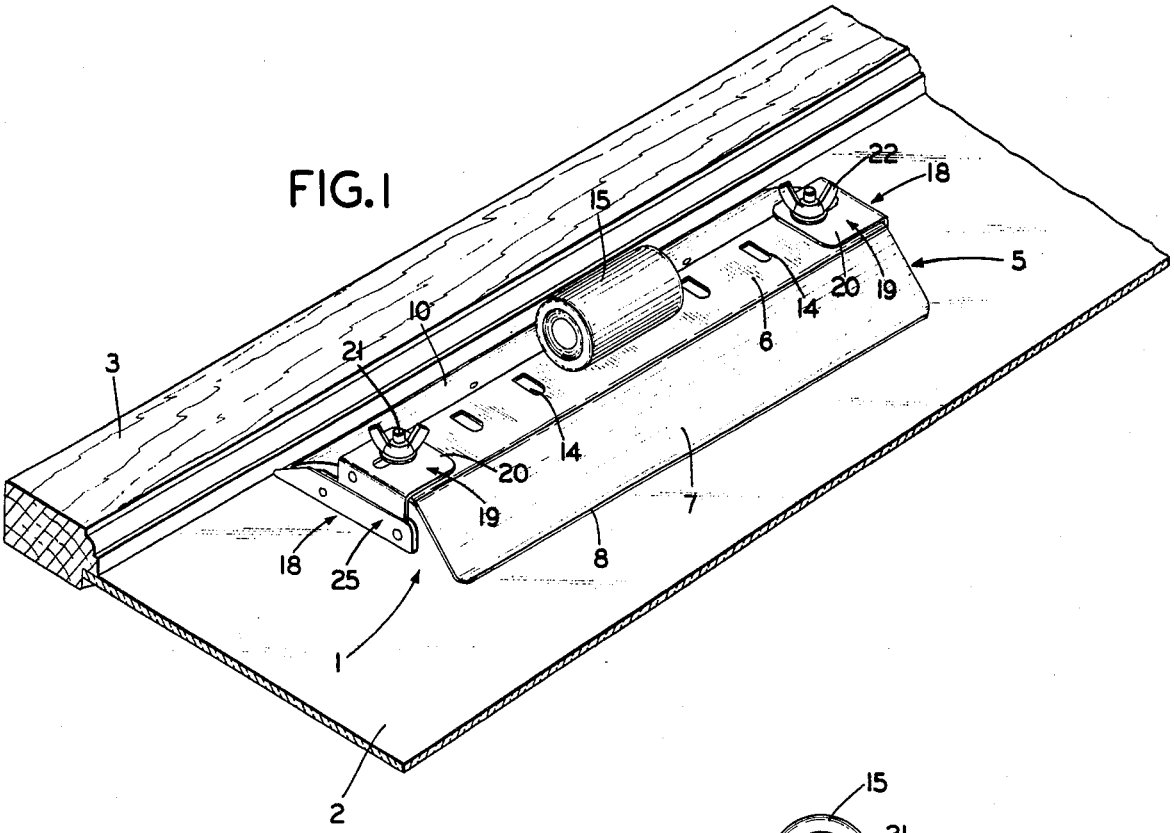
FIG. 3
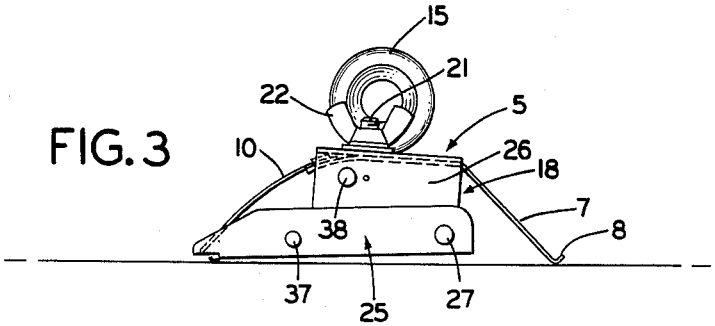
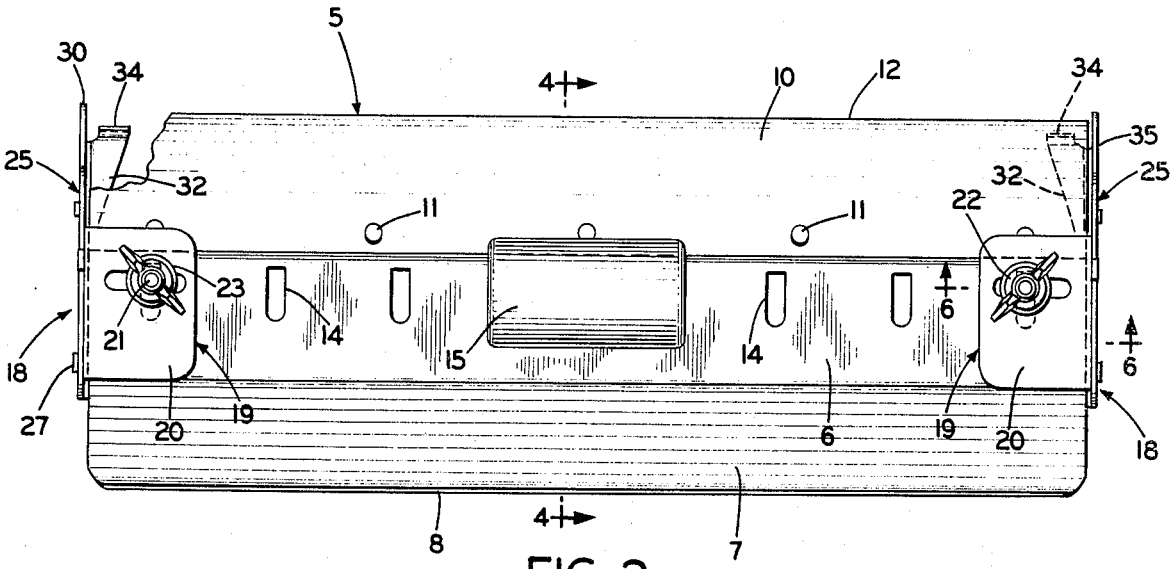
FIG. 2

PAINT GUIDE

BACKGROUND OF THE INVENTION

1. Field of the Invention

The invention relates to devices for use primarily in the painting of window frames and particularly to a paint shield and guide which prevents paint from contacting and smearing unwanted portions of a surface, such as the window glass immediately adjacent the frame or other area being painted. More particularly, the invention relates to a paint guide which enables a predetermined strip of paint to remain on the window glass adjacent the frame to form a weather seal therebetween during painting of the window frame.

2. Description of the Prior Art

It is desirable in painting the wooden frames of windows and doors to extend the paint outwardly a slight distance from the frame onto the adjacent portion of the glass to form a weather seal between the glass and frame, or between the glass and putty or sealing compound to prevent moisture which accumulates on the glass from seeping into the joint between the frame and glass, resulting in deterioration of the wood frame or sealing compound. Also, when painting other frame structures which may be made of metal or synthetic materials, such as plastic, vinyl, or the like, it is desirable to provide a guide or shield to prevent the paint which is being applied to the frame from contacting and being smeared on the adjacent glass. A paint guide will facilitate the painting of a window frame by eliminating the tedious application of the paint to prevent smearing paint on the glass, as heretofore required, and by eliminating the use of outlining the glass with masking tape or other similar procedure to provide for a smooth strip of weatherproofing paint on the glass adjacent the frame.

Various paint guides or masking devices have been constructed to facilitate the painting of window or door frames, such as shown in U.S. Pat. Nos. 1,411,462, 2,098,005 and 3,335,703. Most of these devices require that the edge of the guide device be wiped after each application of paint to a particular frame section adjacent the paint guide, increasing considerably the difficulty and time required for each painting job. Many of these prior devices do not enable a weatherproofing strip of paint to be applied evenly and neatly on the window glass since the guide edge is abutted directly against the adjacent frame. Also, these devices may still smear the glass with paint if they are not removed properly after the painting operation has been completed.

U.S. Pat. No. 3,335,703 discloses a device which is believed to be the closest device known to my paint guide construction. It shows a device which can be positioned a predetermined distance from a window frame to provide for a weatherproofing strip of paint and uses a movable paint guide edge. However, if this device is used for this purpose, it would be extremely difficult to properly position the paint guide edge at the same predetermined distance from the frame for each application to provide for a straight, uniform thickness strip of paint on the window, since there is no positive positioning means provided on this device. Also, rotational movement of the paint guide edge could contact the window frame, smearing the freshly applied paint.

SUMMARY OF THE INVENTION

Objectives of the invention include providing a paint guide construction which is intended primarily for use in painting window frames more quickly and conveniently than known devices, and which provides for a strip of weatherproofing paint to be applied to the window glass adjacent the frame junction during the painting of the frame, and in which the width of this paint strip is adjustable; providing such a device in which the paint sealing edge of the paint shield is moved vertically toward and away from the glass by a link-pivotal mounting arrangement to eliminate smearing of the weatherproof paint strip, freshly painted frame and adjacent unpainted window surface; providing such a device which can be slid along the window frame when moving from a painted area to the adjacent unpainted area, since the supporting surfaces of the paint guide are all spaced away from the window frame and weatherproofing strip with the only contact with the frame being the front projections of the spaced guide supporting arms; providing such a device in which the vertical movement of the paint sealing edge away from the glass and applied paint strip initially is achieved by the biasing force of a pair of coil leaf springs, thereby reducing further the possibility of smearing the freshly painted surface and adjacent unpainted glass areas; providing such a device in which no wiping of the paint shield and paint sealing edge is required after each painting operation due to the vertical movement of the paint sealing edge with respect to the glass surface, and in which positive locating means are provided for accurately positioning the paint sealing edge at the predetermined distance away from the frame for each paint application to form a neat, continuous, straight edge on the weatherproofing paint strip; and providing such a paint guide construction which is of a relatively inexpensive and rugged construction, which eliminates difficulties heretofore encountered, achieves the stated objectives simply and effectively, and solves problems and satisfies needs existing in the art.

These objectives and advantages are obtained by the improved paint guide construction, the general nature of which may be stated as including frame means having a paint shield terminating in a straight edge; a pair of spaced arm means movably mounting the frame means therebetween, said arm means extending generally laterally with respect to the paint shield edge and terminating in front locating ends; spring means engageable with the frame means and arm means, biasing the paint shield toward a raised position wherein the straight edge is disengaged from a surface to be painted; link means operatively engageable with and extending between the frame means and arm means to impart straight line movement to the straight edge when said edge is moved toward or away from said surface; and pin means extending between the arm means and frame means, pivotally movably mounting the frame means on the arm means.

BRIEF DESCRIPTION OF THE DRAWINGS

A preferred embodiment of the invention—illustrative of the best mode in which applicant has contemplated applying the principle—is set forth in the following description and shown in the accompanying drawings, and is particularly and distinctly pointed out and set forth in the appended claims.

FIG. 1 is a perspective view of the improved paint guide construction shown in operating position on a portion of a window;

FIG. 2 is an enlarged top plan view with portions broken away of the improved paint guide construction shown in FIG. 1;

FIG. 3 is a left-hand elevational end view of the improved paint guide construction shown in FIG. 2;

Similar numerals refer to similar parts throughout the drawings.

DESCRIPTION OF THE PREFERRED EMBODIMENT

Figure 4:
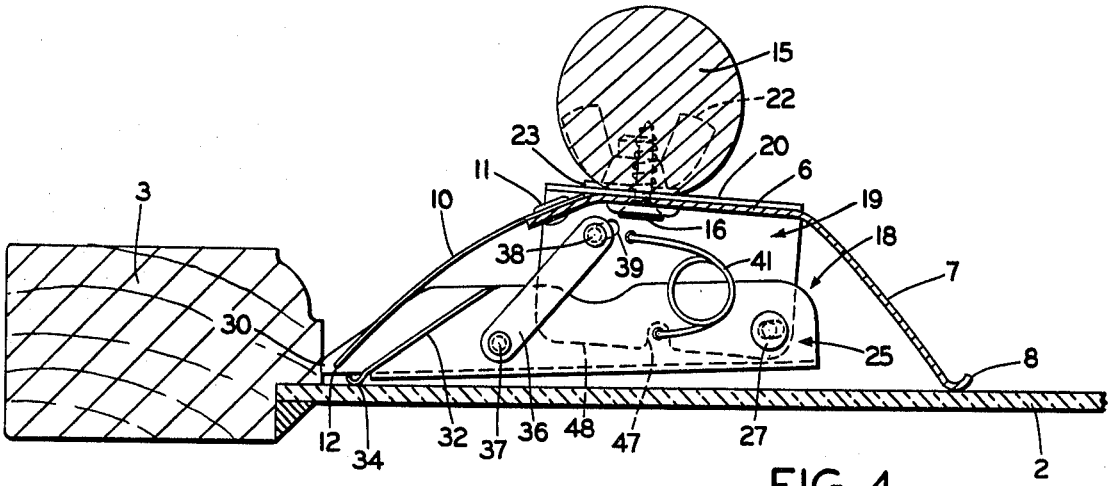
FIG. 4 is an enlarged sectional view taken on line 4—4, FIG. 2, showing the improved paint guide construction in operating position on a window with the paint guide edge shown in a raised position.

The improved paint guide construction is indicated generally at 1, and is shown in FIG. 1 in a usual mode of operation in which it is placed against a pane of window glass 2 and abuttingly engages a window frame 3 for painting the same. Paint guide 1 includes an inverted U-shaped frame, indicated generally at 5, which is formed by a piece of sheet metal having a flat top wall 6 and a downwardly, outwardly extending rear wall 7 which terminates in a rolled edge 8, which preferably extends throughout the length of rear wall 7. A paint shield 10, formed of flexible metal or plastic material is attached to the forward end of frame top wall 6 by a plurality of rivets 11. Paint shield 10 has a somewhat outwardly bowed configuration, shown particularly in FIGS. 3 and 4, and terminates in a straight paint sealing edge 12, which extends longitudinally throughout the length of shield 10.

A plurality of transversely extending slots 14 are formed in top wall 6 of frame 5 to provide an adjustment feature for device 1, as described in greater detail below. A handle 15 is mounted on frame top wall 6 by a plurality of screws 16 which extend through certain of the centrally located slots 14 (FIG. 4).

Frame 5 is movably mounted on and extends between a pair of end supports, indicated generally at 18. Each end support 18 is similar to each other, and therefore, only one is described in detail and shown particularly in the drawings.

Figure 7:
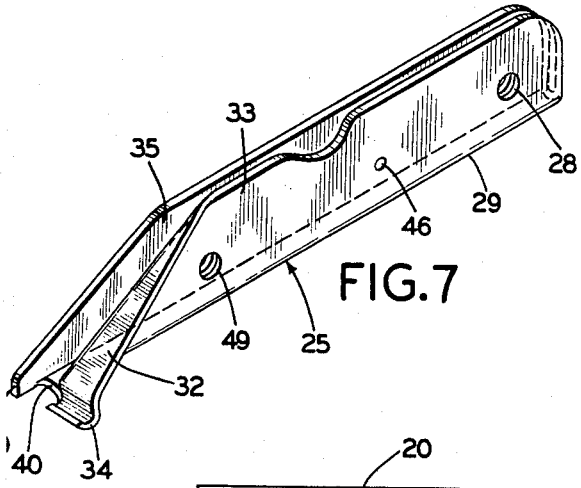
FIG. 7 is a perspective view of one of the supporting arms of the paint guide.
Figure 8:
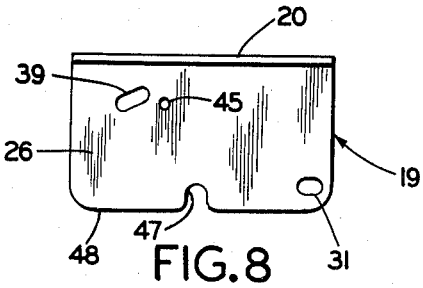
FIG. 8 is a side elevational view of one of the L-shaped mounting brackets of the paint guide.
Figure 6:
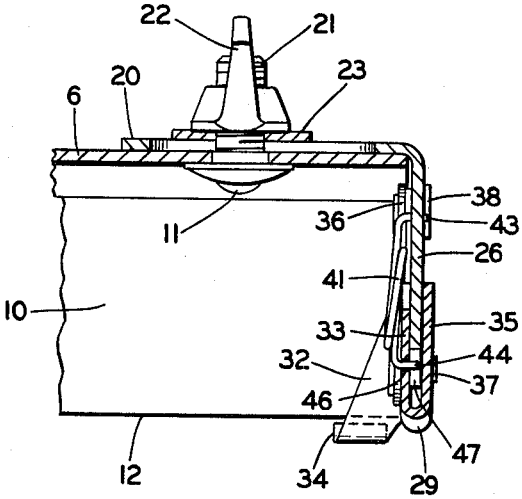
FIG. 6 is an enlarged fragmentary sectional view taken on line 6—6, FIG. 2.

Each end support 18 includes an L-shaped bracket 19 (FIG. 8) having a first or horizontal leg 20 which is attached to frame top wall 6 by a carriage bolt 21 and wing nut 22 (FIG. 6). Bolt 21 extends through the endmost elongated slot 14 of frame wall 6 and may have a washer 23 mounted thereon, which is clamped against bracket leg 20 by wing nut 22. A frame supporting arm, indicated generally at 25 (FIG. 7) is pivotally and movably mounted on a second or vertical leg 26 of bracket 19 by a rivet 27, which is located adjacent the rear edge of arm 25 and extends through a hole 28 formed in arm 25 and through a slot 31 formed in bracket leg 26.

Arm 25 preferably is formed of a piece of sheet metal folded upon itself, forming a rounded bottom edge 29 with bracket leg 26 being received between the folded portions 33 and 35 of arm 25. Each arm 25 terminates in forward end 30 which is adapted to be placed in abutting engagement with window frame 3 when using paint guide 1, in the manner described in greater detail below to provide positive locating means for guide 1. A tab 32 (FIGS. 6 and 7) is formed integrally from inside fold 33 of arm 25 and terminates in a rolled, upturned front edge 34. Edge 34 is spaced inwardly from outer fold 35 by a notch 40, and in accordance with one of the features of the invention, is spaced rearwardly from ends 30 of arms 25.

A link 36 is pivotally mounted on each arm 25 by a rivet 37 which extends through aligned holes 49 formed in the folds of leg 25. A pin 38 projects outwardly from the opposite end of link 36 and extends through and is slidably received in a curved slot 39 formed in the upper portion of leg 26 of bracket 19. A coil leaf spring 41 is operatively mounted on and extends between bracket leg 26 and supporting arm 25 by inturned spring ends 43 and 44 (FIGS. 5 and 6), which project through holes 45 and 46 formed in bracket leg 26 and inner fold 33 of arm 25. A U-shaped notch 47 is formed in the bottom edge 48 of bracket leg 26 to provide clearance for spring end 44.

Figure 5:
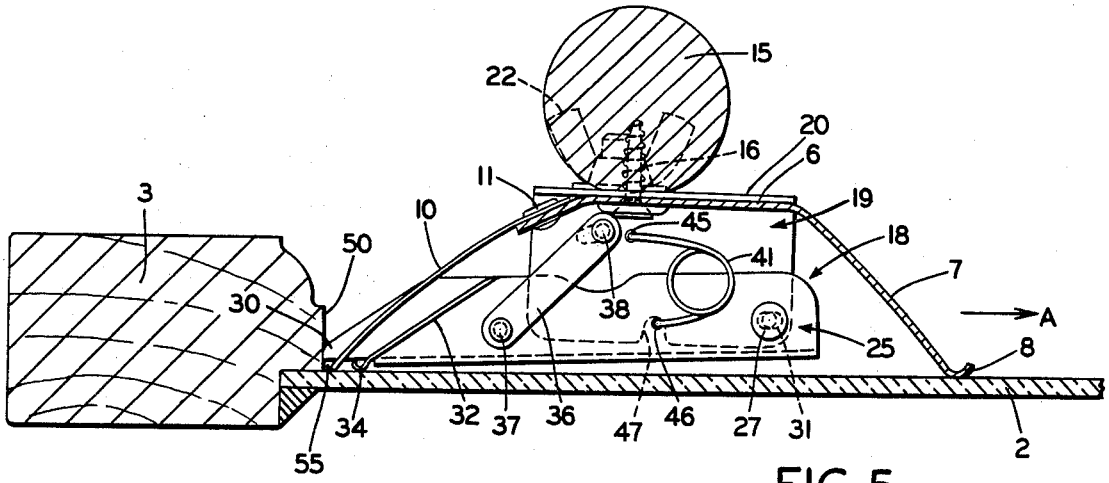
FIG. 5 is a view similar to FIG. 4 with the paint guide edge shown in its lowered, sealed position with the window glass.

The operation of the improved paint guide construction is shown particularly in FIGS. 1, 4 and 5 and described below. Frame 5 is adjusted with respect to end supports 18 by loosening wing nuts 22 and moving frame 5 transversely with respect to end supports 18. This adjustment provides the desired width of a weatherproofing paint strip which will extend outwardly on glass 2 from frame 3, which is the distance between frame edge 50 of frame 3 and paint shield edge 12, indicated at 55.

Device 1 is placed on glass 2 and forward ends 30 of supporting arms 25 are abutted against frame edge 50, as shown in FIGS. 1 and 4. In this position, device 1 is engaged with glass 2 only by rolled front edges 34 of tabs 32 and by rolled edge 8 of frame rear wall 7. These points of contact are the only parts of guide 1 which will contact glass 2, except for paint shield edge 12. Spring 41 biases paint shield 10 away from glass 2 so that paint shield edge 12 initially is spaced from glass 2 when guide 1 is placed thereon. A very slight downward pressure on handle 15 overcomes the biasing force of spring 41, bringing paint edge 12 into contact with glass 2 (FIG. 5). During this initial downward movement, link pin 38 moves from its forward position in bracket slot 39 (FIG. 4) to its rearward position (FIG. 5) limiting this initial downward movement of paint shield 10 and edge 12 when overcoming the biasing of spring 41. The particular angular relationship and curvature of links 36 and bracket slots 39 which control the initial movement of shield 10, enable paint shield edge 12 to move nearly vertically in a straight line fashion into engagement with glass 2 instead of traveling in an arcuate path, as would occur if frame 5 or shield 10 were pivotally mounted on arms 25. This initial movement of shield 10 and edge 12 is limited to the "play" provided by the link-slot arrangement and provides the initial contact of paint shield edge 12 with the glass at the predetermined distance, indicated by space 55 from frame edge 50.

Continued pressure on handle 15 will force paint shield edge 12 tightly against glass 2 to form an effective paint seal therewith. Simultaneously with this sealing engagement, frame 5 moves slightly rearwardly in the direction of Arrow A, FIG. 5, due to the flexibility of paint shield 10 and the mounting of rivet 27 in bracket slot 31. While pressure is maintained on handle 15, paint is applied to frame 3 throughout the area between end supports 18 along shield 10, with the predetermined weatherproofing paint strip being applied on glass 2 throughout space 55. Paint is prevented from contacting the remaining portion of the glass due to the effective seal of paint shield edge 12 with glass 2.

Immediately after paint is applied to frame 3 and to the glass in space 55, pressure is released from handle 15, whereupon frame rear edge 8 will move slightly toward frame 3, followed by the subsequent, vertical movement of edge 12 away from the glass due to the biasing force of spring 41. The action provided by links 36 and slots 39 lifts paint shield edge 12 from the glass without any sliding movement which occurs in many prior devices. This vertical lifting motion prevents smearing of the paint strip in space 55 and smearing of paint onto the remaining unpainted glass surfaces. Guide 1 then can be slid easily along the frame to the adjacent unpainted area without even lifting the guide from the glass since tab edges 34 and rolled rear edge 8 of frame wall 7, which support guide 1, are completely rearward of the painted area 55 and out of contact with any freshly painted area, as can be seen in FIGS. 4 and 5. As soon as guide 1 is moved to the adjacent unpainted area, handle 15 is depressed again, which actuates the sequence of actions described above to effectively seal edge 12 against glass 2 for the next painting operation.

One of the main advantages of paint shield 10 is that it does not have to be wiped of paint which collects thereon after each paint application, since the vertical movement of edge 12 towards and away from glass 2 eliminates any possibility of this paint contacting that portion of the glass surface which is to remain unpainted. Also, notch 40, which is located between forward ends 30 of arms 25 and tab edges 34, prevents pick-up of paint when device 1 is placed in the corner of a window by duplicating the offset of the end support rolled edges 34.

Should no strip of weatherproofing paint be desired, shield 1 is adjusted by the movement of end supports 18 on frame wall 6 so that paint shield edge 12 is located in alignment with the forward locating ends 30 of supporting arms 25. Even in this position, no paint smearing will occur since the particular double action achieved by links 36 in slots 39, and the sliding movement of brackets 19 in arms 25 on pivot pins 27, moves paint shield edge 12 in a straight line vertical manner with respect to glass 2, eliminating contact with frame edge 50 and with unpainted areas of glass 2. Also, if a shorter longitudinal length paint guide is desired, frame 5 can be cut to the desired length after removal of one end support 18, which then is reattached to the endmost slot 14.

The improved paint guide 1 provides a device which is formed relatively inexpensively of stamped sheet metal components which are assembled with relative ease; it enables a weatherproof strip of paint of a variable width to be applied to the glass at the frame junction; it eliminates wiping of the paint shield and sealing edge after each painting application; it enables the shield to be slid rearwardly or laterally along the window frame without smearing the previously applied paint since the supporting surfaces of the paint shield are all rearward of the applied paint strip and frame; and it provides a unique spring-biased lever-control mechanism whereby the paint sealing edge is moved into and out of engagement with the glass in a straight line direction, which eliminates smearing and scuffing at the paint line to provide a neat and straight paint sealing line.

Accordingly, the improved paint guide construction is simplified, provides an effective, safe, inexpensive and efficient device which achieves all the enumerated objectives, provides for eliminating difficulties encountered with prior paint guides and shields, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved paint guide construction is constructed, assembled and operated, the characteristics of the new construction, and the advantageous, new and useful results obtained; the new and useful structures, devices, elements, arrangements, parts, and combinations are set forth in the appended claims.

I claim:

1. A paint guide construction including:

(a) frame means having a paint shield terminating in a straight edge;

(b) a pair of spaced arm means movably mounting the frame means therebetween, said arm means extending generally laterally with respect to the paint shield edge and terminating in front locating ends;

(c) spring means engageable with the frame means and arm means, biasing the paint shield toward a raised position wherein the straight edge is disengaged from a surface to be painted;

(d) link means operatively engageable with and extending between the frame means and arm means to impart straight line movement to the straight edge when said edge is moved toward or away from said surface; and (e) pin means extending between the arm means and frame means, pivotally movably mounting the frame means on the arm means.

2. The construction defined in claim 1 in which the frame means is formed by a generally inverted U-shaped frame having a top wall and a rear wall extending outwardly downwardly therefrom; in which the paint shield is connected to the top wall and extends outwardly downwardly therefrom in a direction opposite to the rear wall; and in which a pair of bracket means is connected to the top wall, each of which is operatively connected to a respective arm means by the spring means, link means and pin means.

3. The construction defined in claim 2 in which a slot is formed in the top wall of the frame means adjacent each end thereof; and in which fastening means extend through the top wall slots and are engaged with the bracket means to adjustably mount the frame means on the bracket means to adjust the paint shield edge laterally with respect to the front ends of the arm means.

4. The construction defined in claim 2 in which the bracket means is an L-shaped bracket having first and second legs; in which the first leg is attached to the top wall of the frame means; in which the link means includes a link pivotally mounted at one end on the arm means and movably mounted at the opposite end in a curved slot formed in the second bracket leg; and in which pin means is mounted on the arm means and extends through a slot formed in the second bracket leg to pivotally movably mount the frame means on the arm means.

5. The construction defined in claim 2 in which the rear wall of the frame means terminates in an outer edge; and in which said rear wall outer edge is adapted to engage a surface on which the paint guide is placed for supporting the paint guide thereon.

6. The construction defined in claim 2 in which handle means is mounted on the top wall of the frame means.

7. The construction defined in claim 1 in which the paint shield has an outwardly bowed cross-sectional configuration and is formed of a material having sufficient stiffness to retain its shape and to provide a paint seal when the straight edge is pressed against a surface, yet will flex sufficiently to permit limited rearward movement of the frame means when the straight edge is pressed against said surface.

8. The construction defined in claim 1 in which the spring means is a pair of leaf springs, each being mounted on an opposite end of the frame means.

9. The construction defined in claim 1 in which a tab extends outwardly from each of the arm means and is located inwardly and rearwardly of the front ends of the arm means; and in which the tabs are adapted to engage a surface on which the paint guide is placed.

10. The construction defined in claim 1 in which the paint shield straight edge is located rearwardly of the front ends of the arm means to provide a space between said edge and a structure being painted when the paint shield is placed on a surface adjacent the structure and the front ends of the arms are abutted against said structure for forming a weatherproofing painted strip in said space on the adjacent surface.

11. A paint guide construction of the type adapted to be placed on a glass window pane when painting the window frame, said construction including:

(a) an arch-shaped member having a paint shield front portion and a window pane engaging rear portion, said paint shield portion terminating in a straight paint sealing edge;

(b) a pair of spaced arms movably supporting the arch-shaped member therebetween, said arms each terminating in a front end which projects outwardly beyond the paint sealing edge, said arms being adapted to abuttingly engage the window frame to space said paint sealing edge a predetermined distance from the window frame to provide an exposed strip of glass at the junction with the window frame for receiving a weatherproofing strip of paint thereon during painting of the frame; and (c) spring means biasing the paint shield front portion toward a raised position whereby the paint sealing edge is disengaged from the window pane until a manual pressure is applied to the arch-shaped member.

12. The paint guide defined in claim 11 in which the paint shield front portion is formed of a sheet of flexible material having an outwardly bowed cross-sectional configuration.

13. The paint guide defined in claim 11 in which the arch-shaped member is movably supported on the arms by a pair of brackets, one at each end of said member; in which a link is pivotally mounted on each arm is engaged in a curved slot formed in a front portion of each bracket to provide a generally straight line movement of the paint sealing end; and in which pin means is mounted on each of the arms and projects into a transversely extending slot formed in a rear portion of each bracket to provide a loose pivotal mounting of the brackets on the arms.

14. The paint guide defined in claim 11 in which tab means is formed on each of the arms and are located inwardly rearwardly of the front ends thereof; and in which the tab means terminate in ends which are adapted to engage the window pane when the paint guide is placed thereon and raise the front ends of the arms out of contact with the glass.

15. The paint guide defined in claim 11 in which the arch-shaped member is adjustably mounted on the arms to adjust the distance of the paint sealing edge from the front ends of the arms.

* * * * *

UNITED STATES PATENT AND TRADEMARK OFFICE

CERTIFICATE OF CORRECTION

PATENT NO. : 4,241,693

DATED : December 30, 1980

INVENTOR(S) : Allen M. Shotwell

It is certified that error appears in the above-identified patent and that said Letters Patent are hereby corrected as shown below:

Column 8, Line 26 - after the word "arm" insert the word - and -.

Signed and Sealed this

*Thirty-first* Day of *March 1981*

[SEAL]

*Attest:*

RENE D. TEGTMEYER

*Attesting Officer*

*Acting Commissioner of Patents and Trademarks*